US006039456A

United States Patent [19]

Chabria

[11] Patent Number: 6,039,456

[45] Date of Patent: Mar. 21, 2000

[54] SQUEEZE-ACTIVATED FLASHLIGHT

[75] Inventor: Paul R. Chabria, Wayne, Ill.

[73] Assignee: Press-A-Lite Corporation, West Chicago, Ill.

[21] Appl. No.: 09/325,949

[22] Filed: Jun. 4, 1999

[51] Int. Cl.[7] ..... F21L 4/00

[52] U.S. Cl. ..... 362/189; 362/205; 362/200

[58] Field of Search ..... 362/189, 200, 362/201, 202, 204, 205, 208

[56] References Cited

U.S. PATENT DOCUMENTS 5,463,539 10/1995 Vandenbelt et al. ..... 362/189

*Primary Examiner*—Y. Quach

*Attorney, Agent, or Firm*—Lee, Mann, Smith, McWilliams, Sweeney & Ohlson

[57] ABSTRACT

A squeeze-activated flashlight including a housing adapted to receive a first battery and a second battery. A lamp holder is attached to one end of the housing and is adapted to receive an illuminating lamp. An electrical switch including a resiliently flexible arm is electrically connected to the batteries and the lamp. A flexible jacket covers and encloses the electrical switch, housing and batteries and is adapted to be squeezed and pressed inwardly to resiliently bend the arm into electrical contact with the batteries and thereby illuminate the lamp. The housing and switch are adapted to be machine assembled.

10 Claims, 2 Drawing Sheets

FIG.1
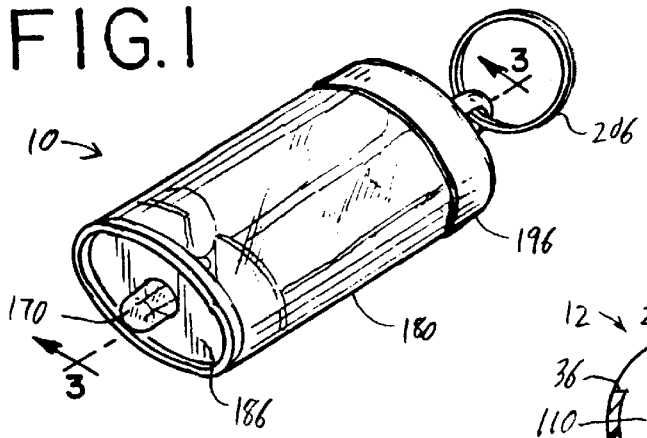
FIG.4
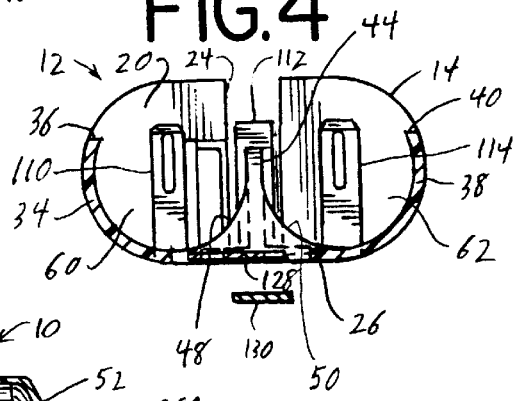
FIG.3
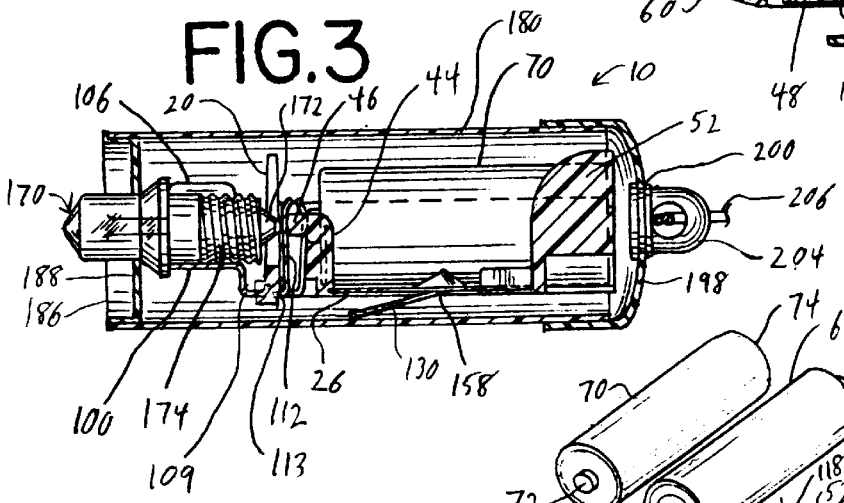
FIG.2

SQUEEZE-ACTIVATED FLASHLIGHT

BACKGROUND OF THE INVENTION

The present invention is directed to a squeeze-activated flashlight having a flexible jacket and a squeeze-activated switch, and in particular to a squeeze-activated flashlight having a carriage assembly disposed within the jacket including a plastic housing adapted to receive one or more batteries and a plurality of metal electrical contacts that are adapted to electrically contact the batteries which can be assembled by a machine.

Prior squeeze-activated flashlights such as disclosed in U.S. Pat. No. 5,660,458, which is assigned to Press-A-Lite Corporation, the applicant herein, include a plastic housing, a plurality of metal electrical contacts adapted to electrically contact a pair of batteries, and a pair of electrical conductor members that form an electrical switch adapted to selectively illuminate a lamp. In such prior flashlights the metal electrical contacts and conductor members are hand fitted and assembled with the plastic housing. Consequently the assembly of the electrical contacts and conductor members with the housing was a very time consuming and labor intensive task. The present invention provides a plastic housing wherein the electrical contacts and conductor members are partially embedded within the housing during molding of the housing such that the carriage assembly of the flashlight may be easily and quickly assembled by machine thus greatly reducing the overall amount of time and labor required to assemble the flashlight.

SUMMARY OF THE INVENTION

A flashlight including a carriage assembly including a plastic housing having a first end and a second end. The housing includes a first end wall at the first end of the housing and a second end wall located at the second end of the housing. The first end wall includes an aperture. A bottom wall extends between the first and second end walls. A first side wall and a second side wall are respectively located on opposite sides of the bottom wall and extend between the first and second end walls. An open-top chamber is located between the first and second end walls and is adapted to receive a first battery and a second battery. A first partition is located adjacent the first end wall and between the first and second side walls. A second partition is located adjacent the second end wall and between the first and second side walls. The second partition is spaced apart from the first partition. The first and second partitions are adapted to form a first cradle with the first side wall which is adapted to receive the first battery, and are adapted to form a second cradle with the second side wall which is adapted to receive the second battery.

A lamp holder is attached to the first end of the housing and is located externally of the housing. The lamp holder is adapted to receive and retain a lamp including a first terminal and a second terminal. A first electrical contact is located within the first cradle adjacent the first end wall and is adapted to electrically engage the first battery. A second electrical contact is electrically connected to the first electrical contact and is located generally between the aperture in the first end wall and the first partition. The lamp extends through the aperture in the first end wall such that the first terminal of the lamp electrically engages the second electrical contact. A third electrical contact is located within the second cradle adjacent the first end wall and is adapted to electrically engage the second battery. The third electrical contact is in electrical communication with the lamp holder and the second terminal of the lamp. A fourth electrical contact is located in the first cradle at the second end wall and is adapted to electrically engage the first battery. A fifth electrical contact is located in the second cradle at the second end wall and is adapted to electrically engage the second battery.

An electrical switch is attached to the housing and is adapted to provide selective electrical communication between the first and second batteries to illuminate the lamp. The electrical switch includes a first electrical conductor member having a first end disposed within an aperture in the bottom wall of the housing and a second end in electrical communication with the fourth electrical contact. The electrical switch includes a second electrical conductor member having a first end and a second end. The second end of the second electrical conductor member is in electrical communication with the fifth electrical contact. Each of the electrical contacts and each of the electrical conductor members of the electrical switch are at least partially embedded within the plastic housing. The first end of the second electrical conductor member is normally located out of electrical contact with the first electrical conductor member. The second electrical conductor member is resiliently bendable such that the first end of the second electrical conductor member may be selectively pressed into electrical contact with the first electrical conductor member. A flexible jacket covers the electrical switch and is adapted to be pressed inwardly and thereby resiliently bend the second electrical conductor member into electrical contact with the first electrical conductor member and thereby illuminate the lamp.

BRIEF DESCRIPTION OF THE DRAWING FIGURES

FIG. 1 is a perspective view of one embodiment of the squeeze-activated flashlight of the present invention.

FIG. 2 is an exploded view of the flashlight.

FIG. 3 is a side cross-sectional view of the flashlight.

FIG. 4 is a cross-sectional view taken along line 4—4 of FIG. 2.

DETAILED DESCRIPTION OF THE PREFERRED EMBODIMENTS

Figures 5, 6, 7:
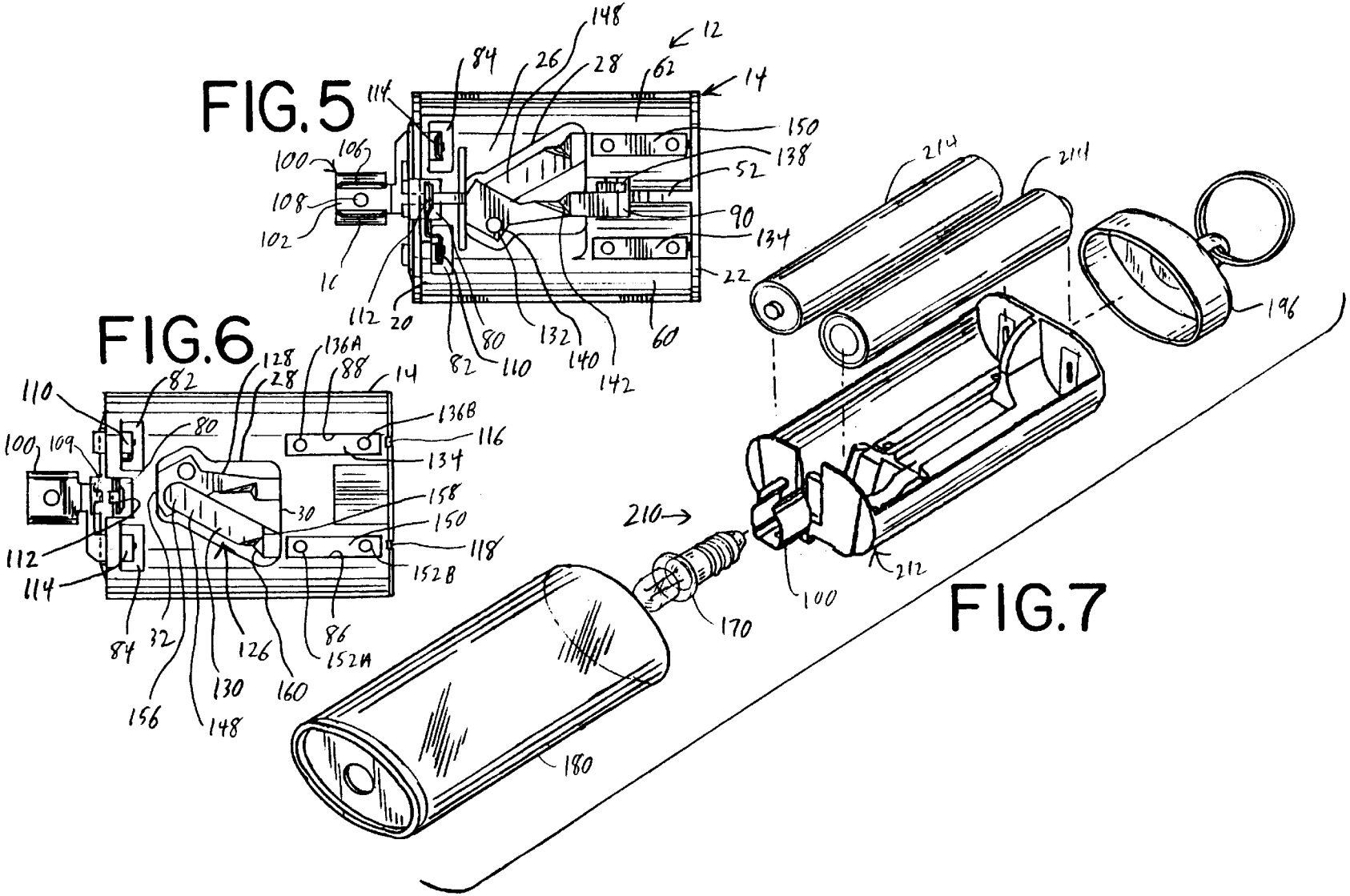
FIG. 5 is a top plan view of the carriage assembly of the flashlight.
FIG. 6 is a bottom view of the carriage assembly.
FIG. 7 is an exploded view of a second embodiment of the squeeze-activated flashlight of the present invention.

The squeeze-activated flashlight 10, in one embodiment of the present invention as shown in FIGS. 1–6, includes a carriage assembly 12 having a housing 14 with a first end 16 and a second end 18. The housing 14 is integrally formed and molded from a plastic or other nonelectrically-conductive moldable material. The housing 14 includes a generally planar first end wall 20 located at the first end 16 of the housing 14 and a generally planar second end wall 22 located at the second end 18 of the housing 14. The first and second end walls 20 and 22 are spaced apart from one another and are generally parallel to one another. The first end wall 20 includes a generally rectangular aperture 24 that includes an open end at the top end of the first end wall 20. The housing 14, as best shown in FIGS. 5 and 6, includes a bottom wall 26 that extends from the first end wall 20 to the second end wall 22. The bottom wall 26 includes an aperture 28 having a first generally linear edge 30 and a spaced apart and generally parallel second generally linear edge 32. The first and second linear edges 30 and 32 extend generally parallel to the first and second end walls 20 and 22.

The housing 14 includes a first side wall 34 attached to a first side of the bottom wall 26 and that extends between the first end wall 20 and the second end wall 22. The first side wall 34 is generally cylindrically curved. The first side wall 34 extends from the bottom wall 26 to a generally linear top edge 36. The housing 14 also includes a second side wall 38 that is attached to a second side of the bottom wall 26 and that extends between the first end wall 20 and the second end wall 22. The second side wall 38 is generally cylindrically curved. The second side wall 38 extends from the bottom wall 26 to a generally linear top edge 40. As best shown in FIG. 4, the top ends of the side walls 34 and 38 are curved inwardly. A chamber 42 is formed between the bottom wall 26, first and second end walls 20 and 22, and the side walls 34 and 38 which is open at its top.

The housing 14 includes a first partition 44 located within the chamber 42 and adjacent the first end wall 20 that extends upwardly from the bottom wall 26. The first partition 44 is located generally midway between the side walls 34 and 38. The first partition 44 is located between the second linear edge 32 of the aperture 28 in the bottom wall 26 and the first end wall 20. The upper end of the first partition 44 includes a finger 46 that extends outwardly and generally horizontally from the top end of the first partition 44 toward the aperture 24 in the first end wall 20. The bottom end of the first partition 44 includes a first generally cylindrically curved surface 48 at one side and a second generally cylindrically curved surface 50 on a second and opposite side of the first partition 44.

A second partition 52 extends upwardly from the bottom wall 26 and is attached to the second end wall 22. The second partition 52 is located generally midway between the first side wall 34 and the second side wall 38 and is spaced apart from the first linear edge 30 of the aperture 28 in the bottom wall 26. The second partition 52 extends upwardly to the top edge of the second end wall 22. The bottom end of the second partition 52 includes a first generally cylindrically curved surface 54 on a first side and a second generally cylindrically curved surface 56 on an opposite second side. The first partition 44 and the second partition 52 are generally aligned with one another along the longitudinal central axis of the housing 14 and are spaced apart from one another.

The first and second partitions 44 and 52 in connection with the first side wall 34 form a first open-top cradle 60 that extends from the first end wall 20 to the second end wall 22. The first and second partitions 44 and 52 and the second side wall 38 form a second cradle 62 therebetween that extends from the first end wall 20 to the second end wall 22. The first cradle 60 is adapted to removably receive a first battery 64 having a positive terminal 66 at one end and a negative terminal 68 at a second end. The second cradle 62 is adapted to removably receive a second battery 70 having a positive terminal 72 at a first end and a negative terminal 74 at a second and opposite end. The batteries 64 and 70 are preferably dry cell batteries and may be of various different sizes including N-size. The curved side walls 34 and 38 and the curved surfaces 48, 50, 54 and 56 of the first and second partitions 44 and 52 are adapted to conform to the generally cylindrical shape of the batteries 64 and 70. The inwardly curved upper ends of the side walls 34 and 38 are adapted to grip and removably retain the batteries 64 and 70 within their respective cradles 60 and 62.

The bottom wall 26 of the housing 14 includes a generally rectangular aperture 80 at the first end 16 which is generally located midway between the side walls 34 and 38 and that is located between the first end wall 20 and the first partition 44. The bottom wall 26 also includes a generally rectangular aperture 82 located at the first end 16 of the housing 14 adjacent the first end wall 20 within the first cradle 60. The bottom wall 26 also includes a generally rectangular aperture 84 located at the first end 16 of the housing 14 and adjacent the first end wall 20 within the second cradle 62. The bottom wall 26 of the housing 14 also includes an elongate generally rectangular aperture 86 in the first cradle 60 that extends from adjacent the second end wall 22 to a position adjacent the first linear edge 30 of the aperture 28. The bottom wall 26 also includes an elongate generally rectangular aperture 88 located within the second cradle 62 that extends from adjacent the second end wall 22 to a position adjacent the first linear edge 30 of the aperture 28. A recessed pocket 90 is formed in the interior surface of the bottom wall 26 which is located between the second partition 52 and the aperture 28. The housing 14 is preferably molded as a single integral piece.

The carriage assembly 12 also includes a lamp holder 100 having a base 102 and first and second arms 104 and 106 which extend outwardly from opposite sides of the base 102 generally parallel and spaced apart from one another. The base 102 includes a circular aperture 108. The lamp holder 100 is an electrical conductor and is preferably formed from a metal material. The ends of the first and second arms 104 and 106 may be resiliently spread apart from one another. The lamp holder 100 is connected to the first end 16 of the housing 14 in alignment with the aperture 24 in the first end wall 20 by a tab 109. The lamp holder 100 is located externally to the housing 14 and the chamber 42. The tab 109 has a first end connected to the lamp holder 100 and a second end which is embedded within the housing 14.

The carriage assembly 12 includes a first electrical contact 110 located within the first cradle 60 adjacent the first end wall 20. The bottom end of the first electrical contact 110 is embedded within the bottom wall 26. The first electrical contact 110 includes a generally rectangular portion that extends vertically upwardly and that is generally centrally located above the aperture 82 in the bottom wall 26 of the housing 14. A second electrical contact 112 includes a generally rectangular portion that is located generally centrally above the aperture 80 in the bottom wall 26 and that is located between the first partition 44 and the aperture 24 in the first end wall 20. The second electrical contact 112 engages the finger 46 of the first partition 44. The bottom end of the second electrical contact 112 is connected to the first end wall 20 by a tab that is connected to the first electrical contact 112 and that is embedded within the first end wall 20 of the housing 14. The bottom end of the second electrical contact 112 also includes a tab 113 that was initially attached to the tab 109, but that was severed from the tab 109 when the tab 109 was embedded in the housing 14. The second electrical contact 112 is in electrical communication with the first electrical contact 110. A third electrical contact 114 is located in the second cradle 62 adjacent the first end wall 20. The third electrical contact 114 includes a generally rectangular portion that extends vertically upwardly and that is generally centrally located above the aperture 84 in the bottom wall 26. The bottom end of the third electrical contact 114 is embedded within the bottom wall 26 of the housing 14. The third electrical contact 114 is in electrical communication with the lamp holder 100.

A fourth electrical contact 116 is located in the first cradle 60 at the second end 18 of the housing 14. The fourth electrical contact 116 is preferably embedded within the second end wall 22 around its perimeter such that an elongate rectangular interior surface of the fourth electrical contact 116 is in communication with the chamber 42 and such that an elongate rectangular exterior surface portion of the fourth electrical contact 116 is exposed through the exterior surface of the second end wall 22 of the housing 14. A fifth electrical contact 118 is located within the second cradle 62 at the second end 18 of the housing 14. The fifth electrical contact 118 is preferably embedded within the second end wall 22 around its perimeter such that a generally rectangular interior surface portion is in communication with the chamber 42 and such that a generally rectangular outer surface portion of the fifth electrical contact 118 is exposed through the outer surface of the second end wall 22. All of the electrical contacts 110, 112, 114, 116 and 118 are preferably formed from a metal electrical conducting material.

When the batteries 64 and 70 are inserted into their respective cradles 60 and 62, the positive terminal 66 of the first battery 64 is in electrical engagement with the fourth electrical contact 116. The negative terminal 68 of the first battery 64 is in electrical contact with the first electrical contact 110. The positive terminal 72 of the second battery 70 is in electrical contact with the third electrical contact 114. The negative terminal 74 of the second battery 70 is in electrical contact with the fifth electrical contact 118.

The carriage assembly 12 also includes an electrical switch 126 which is normally open, but which may be selectively closed to electrically connect the batteries 64 and 70 in series. The electrical switch 126 includes a first electrical conductor member 128 and a second electrical conductor member 130. As best shown in FIGS. 5 and 6, the first conductor member 128 includes a first end 132 and a second end 134. The second end 134 of the first conductor member 128 is partially embedded within the bottom wall 26 of the housing 14 such that the second end 134 extends within and substantially fills the aperture 88 in the bottom wall 26 of the housing 14. An interior surface of the second end 134 is thereby exposed and in communication with the chamber 42 and an exterior surface of the second end 134 is exposed to the exterior of the housing 14. The second end 134 includes spaced apart circular apertures 136A and B. The second end 134 of the first conductor member 128 is in electrical communication with the fourth electrical contact 116. The second end 134 of the first electrical conductor member 128 is generally located midway between the second partition 52 and the side wall 34.

The first end 132 of the first conductor member 128 is electrically connected to the second end 134 and is offset transversely from the second end 134 toward the middle of the bottom wall 26. The first end 132 is partially located within the pocket 90 of the bottom wall 26 and extends across the aperture 28 in the bottom wall 26 from the first linear edge 30 to the second linear edge 32. The first end 132 is embedded within the bottom wall 26 at the second linear edge 32 of the aperture 28. The first end 132 is secured within the pocket 90 by a tab 138. The first end 132 includes a generally circular aperture 140.

The first conductor member 128 is generally plate-like and planar except that the first end 132 includes a raised dimple 142 that extends upwardly into the chamber 42. The dimple 142 is generally V-shaped and includes first and second generally triangular walls. The first end 132 of the first conductor member 128 forms an opening in conjunction with the aperture 28 on each side of the first end 132 that extends through the carriage assembly 12. As shown in FIG. 5, the first conductor member 128 extends from a position within the pocket 90 transversely to the second end 134 such that the transverse portion of the first conductor member 128 is embedded within the bottom wall 26 of the housing 14.

The second conductor member 130 includes a first end 148 and a second end 150. The second end 150 of the second conductor member 130 is partially embedded within the bottom wall 26 such that the second end 150 extends within and substantially fills the aperture 86 in the bottom wall 26. An interior surface of the second end 150 is exposed to and in communication with the chamber 42. An exterior surface of the second end 150 is exposed to the exterior of the carriage assembly 12. The second end 150 includes spaced apart circular apertures 152A–B. The second end 150 of the second conductor member 130 is in electrical communication with the fifth electrical contact 118.

The first end 148 of the second conductor member 130 includes a resiliently flexible arm 154 that extends from the first linear edge 30 of the aperture 28 in a cantilevered manner toward the first linear edge 30 of the aperture 28. A tip 156 of the arm 154 overlies the first end 132 of the first conductor member 128 in a normally spaced relation. The second conductor member 130 includes a fulcrum 158 which comprises a bend in the arm 154 of the second electrical conductor member 130. The second electrical conductor member 130 is generally planar from the second end 150 to the fulcrum 158. The arm 154 extends generally linearly from the fulcrum 158 to the tip 156 in a downwardly and outwardly direction away from the housing 14 and the chamber 42 as shown in FIG. 3. If desired, the second electrical conductor member 130 may include a raised dimple 160 located at the fulcrum 158. The arm 154 is resiliently flexible along its length between the fulcrum 158 and the tip 156 such that the tip 156 may be selectively pressed or squeezed into electrical contact with the first end 132 of the first electrical conductor member 128. The electrical switch 126 is located at the bottom wall 26 of the housing 14 such that it does not interfere with the removal and replacement of the batteries 64 and 70. The circular apertures 108, 136A–B, 140 and 152A–B and the dimples 142 and 160 are adapted to assist in the automated assembly, manipulation and construction of the carriage assembly 12 by a machine.

The flashlight 10 includes an illuminating lamp 170 having a first terminal 172 located at one end of the lamp 170, a second generally cylindrical terminal 174, and an illuminating bulb 176 located at a second end of the lamp 170. The lamp 170 is located within and is removably retained by the lamp holder 100 such that the generally cylindrical second terminal 174 is clamped between the first and second arms 104 and 106 of the lamp holder 100. The lamp holder 100 is thereby in electrical communication with the second terminal 174. The lamp 170 extends through the aperture 24 in the first end wall 20 such that the first terminal 172 is in electrical contact with the second electrical contact 112 and thereby the first electrical contact 110. The finger 46 of the first partition 44 prevents the lamp 170 and second electrical contact 112 from moving longitudinally toward the second end 18 of the housing 14.

The flashlight 10 also includes a flexible and resilient generally tubular jacket 180 having a first end 182 and a second end 184. The jacket 180 is generally elliptical in cross section but may be formed in other shapes as desired such as circular or rectangular. The jacket 180 is generally formed from a flexible plastic material and is preferably clear. A liner (not shown), such as a sheet of paper, may be inserted within the jacket 180 to line the interior surface of the wall of the jacket 180. The liner may include printed indicia or advertising as desired which is visible through the jacket 180 to users of the flashlight 10. The carriage assembly 12 is located within the jacket 180 such that the jacket 180 covers the electrical switch 126.

A first end cap 186 is attached to and substantially encloses the first end 182 of the jacket 180. The end cap 186 includes a generally elliptical-shaped planar wall 188 having a generally centrally located circular aperture 190. The bulb 176 of the lamp 170 extends through the aperture 190. The end cap 186 also includes a generally elliptical-shaped side wall 192 that extends generally perpendicularly and outwardly from the wall 188.

A second end cap 196 is adapted to substantially enclose the second end 184 of the jacket 180. The end cap 196 includes a wall 198 having a generally centrally located circular aperture 200 and a generally elliptical side wall 202 that is adapted to fit over the second end 184 of the jacket 180. A stem 204 is located within the aperture 200 and is rotatably attached to the wall 198. A split-ring key ring 206, or other device such as a chain or lanyard, is attached to the stem 204.

In operation, the bulb 176 of the lamp 170 is illuminated by pressing the flexible jacket 180 inwardly toward the bottom wall 26 of the housing 14 and thereby resiliently bending the arm 154 of the second conductor member 130 such that the tip 156 electrically contacts the first end 132 of the first conductor member 128 thereby completing a circuit between the batteries 64 and 70 and the lamp 170. When the pressure on the jacket 180 is released, the jacket 180 resiliently returns to its original position and the tip 156 of the arm 154 resiliently flexes away from the first conductor member 128 to break or open the electrical connection with the lamp 170.

FIG. 7 shows an alternate embodiment of the flashlight of the present invention designated with the reference number 210. The flashlight 210 is constructed substantially identical to the flashlight 10 except that the flashlight 210 includes a housing 212 that is longer in the longitudinal direction than the housing 14. The housing 212 is thereby adapted to removably receive a pair of AAA size batteries 214. The flashlight 210 operates substantially identically to the flashlight 10.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A flashlight comprising:

a housing having a first end and a second end, said housing including a first end wall at said first end of said housing, said first end wall including an aperture, a second end wall at said second end of said housing, a bottom wall located between said first and second end walls, a first side wall and a second side wall, said first and second side walls being respectively located on opposite sides of said bottom wall, a chamber located between said first and second end walls adapted to receive a first battery and a second battery, a first partition located adjacent said first end wall and between said first and second side walls, a second partition located adjacent said second end wall and between said first and second side walls, said second partition being spaced apart from said first partition, said first and second partitions and said first side wall forming a first cradle adapted to receive the first battery and said first and second partitions and said second side wall forming a second cradle adapted to receive the second battery;

a lamp including a first terminal and a second terminal;

a lamp holder attached to said first end of said housing and located externally of said housing, said lamp holder receiving and retaining said lamp;

a first electrical contact located within said first cradle adjacent said first end wall adapted to electrically engage the first battery, a second electrical contact electrically connected to said first electrical contact, said second electrical contact located between said aperture in said first end wall and said first partition, said lamp electrically engaging said second electrical contact, a third electrical contact located within said second cradle adjacent said first end wall adapted to electrically engage the second battery, said third electrical contact being in electrical communication with said second terminal of said lamp, a fourth electrical contact located in said first cradle at said second end wall adapted to electrically engage the first battery, and a fifth electrical contact located in said second cradle at said second end wall adapted to electrically engage the second battery;

an electrical switch adapted to provide selective electrical communication between the first and second batteries and said lamp, said electrical switch including a first electrical conductor member having a first end and a second end, said first end of said first electrical conductor in electrical communication with said fourth electrical contact, and a second electrical conductor member having a first end and a second end, said first end of said second electrical conductor member in electrical communication with said fifth electrical contact, said second end of said second electrical conductor member normally located out of electrical contact with said first electrical conductor member, said second electrical conductor member being resiliently bendable such that said second end of said second electrical conductor member may be selectively pressed into electrical contact with said first electrical conductor member; and a flexible jacket covering said electrical switch, said jacket adapted to be pressed inwardly and thereby resiliently bend said second electrical conductor member into electrical contact with said first electrical conductor member and thereby illuminate said lamp.

2. The flashlight of claim 1 wherein said second electrical conductor member includes a tip and a fulcrum located in an aperture in said bottom wall of said housing, said fulcrum limiting bending of said second electrical conductor member to a portion thereof located between said fulcrum and said tip.

3. The flashlight of claim 1 wherein said bottom wall of said housing includes a first aperture, said first electrical conductor member extending across said aperture, said first and second ends of said first electrical conductor member being attached to said housing.

4. The flashlight of claim 3 wherein said first and second ends of said first electrical conductor member are at least partially embedded within said housing.

5. The flashlight of claim 3 wherein said second electrical conductor member is generally thin and planar and includes a raised dimple located within said first aperture of said bottom wall.

6. The flashlight of claim 3 wherein said bottom wall includes a second aperture and a third aperture, said second end of said first electrical conductor member being at least partially embedded within said bottom wall and extending within said second aperture of said bottom wall, said second end of said second electrical conductor member being at least partially embedded within said bottom wall and extending within said third aperture of said bottom wall.

7. The flashlight of claim 6 wherein said first electrical conductor member includes a fourth aperture that is located within said second aperture of said bottom wall, and said second electrical conductor member includes a fifth aperture that is located within said third aperture of said bottom wall.

8. The flashlight of claim 1 wherein said fourth electrical contact and said fifth electrical contact are each at least partially embedded within said second end wall.

9. The flashlight of claim 1 wherein said second electrical contact includes a first end embedded within said housing and a second end engaging said first partition.

10. The flashlight of claim 9 wherein said first partition includes an outwardly extending finger that engages said second end of said second electrical contact.

* * * * *